United States Patent [19]

Mueller

[11] Patent Number: 4,699,413

[45] Date of Patent: Oct. 13, 1987

[54] AUXILIARY DOOR LATCH

[76] Inventor: Theodore V. Mueller, 760 Preakness La., Florissant, Mo. 63033

[21] Appl. No.: 861,981

[22] Filed: May 12, 1986

[51] Int. Cl.[4] ..... E05C 5/02; E05C 3/04

[52] U.S. Cl. ..... 292/67; 292/101

[58] Field of Search ..... 292/63, 67, 95, 101, 292/105, 149, 145

[56] References Cited

U.S. PATENT DOCUMENTS

| | | | |
|---|---|---|---|
| 637,160 | 11/1899 | Richter | 292/101 X |
| 1,035,005 | 8/1912 | Harris | 292/67 |
| 1,284,399 | 11/1918 | McManus | 292/67 X |
| 1,513,234 | 10/1924 | Fritsch | 292/101 |
| 1,531,947 | 3/1925 | Jamieson et al. | 292/63 X |
| 1,542,468 | 6/1925 | Mueller | 292/63 X |
| 1,658,762 | 2/1928 | Dickerson | 292/67 X |
| 2,467,032 | 4/1949 | Hill | 292/67 |
| 3,431,000 | 3/1969 | Choiniere | 292/95 |

FOREIGN PATENT DOCUMENTS

| | | | |
|---|---|---|---|
| 1309134 | 10/1962 | France | 292/67 |

*Primary Examiner*—Richard E. Moore

*Attorney, Agent, or Firm*—Kalish & Gilster

[57] ABSTRACT

An auxiliary door latch for use with a door swingably mounted on one side thereof to a side element of a door frame and with the other side of said door being free comprising a first door latching component fixed upon the side element of the frame proximate the free end of the door when the latter is in closed condition; there being a second door latching component suitably mounted upon the door proximate its free end for swingable movement between engaged latch-forming relationship with said first door latching component when the door is in closed condition and disengaged state for permitting door movement.

3 Claims, 7 Drawing Figures

FIG. 1
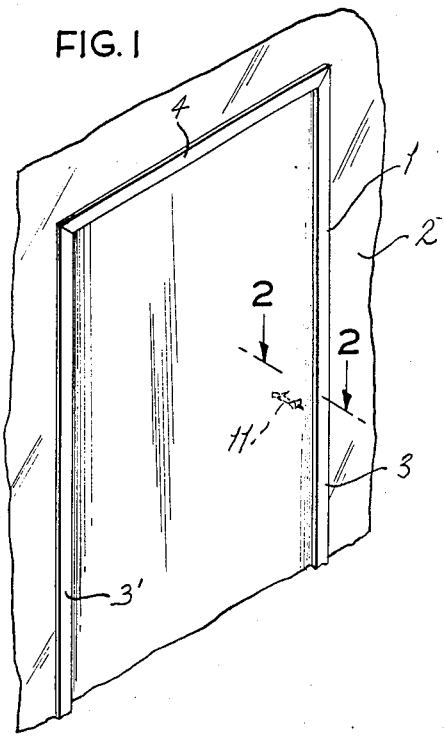
FIG. 3
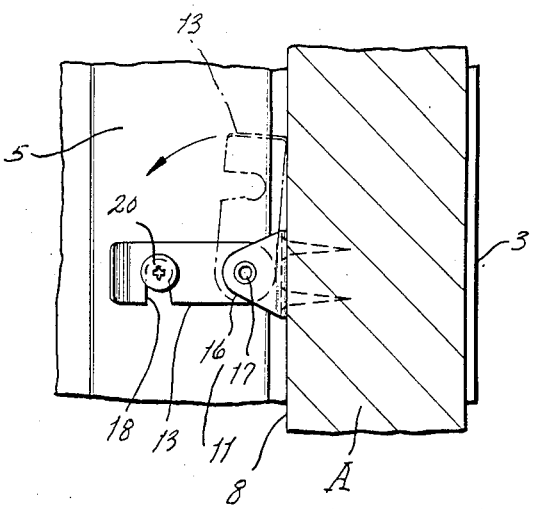
FIG. 2
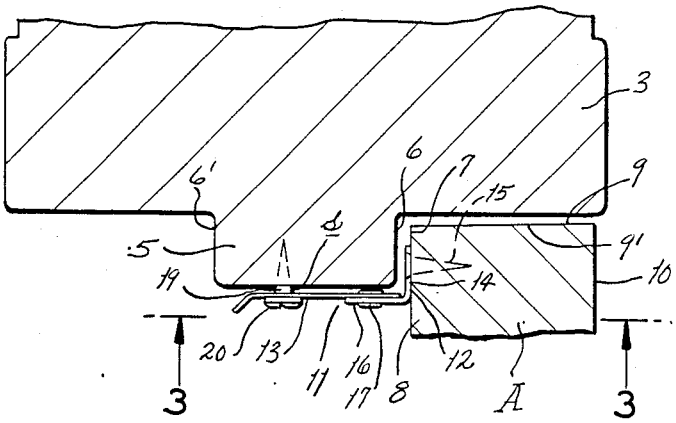
FIG. 5
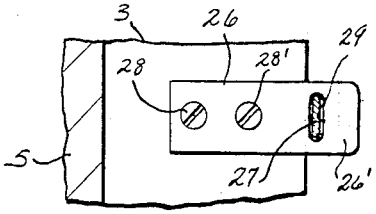
FIG. 6
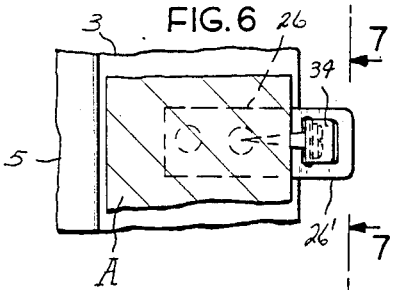
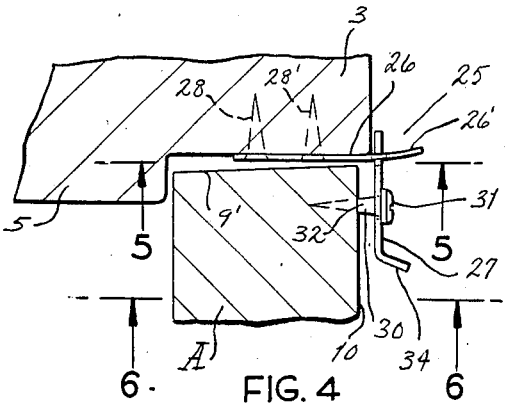
FIG. 4
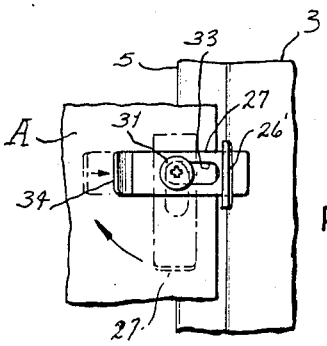
FIG. 7

AUXILIARY DOOR LATCH

BACKGROUND AND SUMMARY OF THE INVENTION

This invention relates in general to door fastening means and, more particularly, to an auxiliary latch for preventing unauthorized door opening by children.

Heretofore, various efforts have been undertaken for providing a fastener to be utilized with primarily doors and sometimes windows in addition to the provided locks or latches for preventing the opening of the door or window as the case may be by a child who may have previously determined the appropriate operation of the provided latch or lock. Such prior attempts are exemplified by U.S. Pat. No. 2,128,479, which comprehends a complex member developed as of spring steel and incorporating interacting elements as well as being designed for permanent adherence to one of the door components. The Andreas U.S. Pat. No. 1,516,692 also shows a door fastener comprising a pair of coacting intricately constructed elements for rigid adherence to the door and adjacent jamb. The child-proof latch of the Hillman patent is a very complex device containing a multiplicity of components which are integrated into the door structure. Other attempts to solve the problem of inhibiting improper entry into a room by a child are shown in the Wilzig et al U.S. Pat. No. 4,159,838; Reidhaar U.S. Pat. No. 1,773,751 and the Schuette U.S. Pat. No. 3,309,126. A careful review of these last-mentioned patents will disclose the fundamental objection to all current expedients for rendering doors child-proof and that is the complexity of the individual constituents of the systems used and the necessity of affixing same in a manner which requires all too often modification of the door components.

Therefore, it is an object of the present invention to provide an auxiliary door latch which may be easily applied to existing door constructions without necessitating any fundamental modification thereof.

It is another object of the present invention to provide an auxiliary door latch which is of a detachable character so that it may be optionally applied to a particular door construction when desired an thus not necessarily remain a permanent component thereof.

It is another object of the present invention to provide a door latch of the character stated which can be applied to the door and related structure in a preselected manner for facile compatibility with the structure involved.

It is a still further object of the present invention to provide an auxiliary door latch comprising a limited number of durable components which may be most economically produced so that the replacement of any one or all of the same is easily achieved.

It is still another object of the present invention to provide an auxiliary latch of the character stated which is entirely reliable in usage; which may be affixed in operative position by the average unskilled individual; which is durable in usage; and which is reliably effective.

BRIEF DESCRIPTION OF THE DRAWINGS

FIG. 1 is a fragmentary perspective view of a door construction, supplied with an auxiliary door latch constructed in accordance with and embodying the present invention; the door being in latched condition.

FIG. 2 is a horizontal transverse sectional view taken along line 2—2 of FIG. 1.

FIG. 3 is a fragmentary vertical transverse sectional view taken along line 3—3 of FIG. 2 illustrating the latch-operative condition in full lines and in inoperative condition in phantom lines.

FIG. 4 is a horizontal transverse sectional view taken substantially on the line 2—2 of FIG. 1 but illustrating another form of auxiliary door latch constructed in accordance with and embodying the present invention.

FIG. 5 is a fragmentary horizontal transverse sectional view taken along the line 5—5 of FIG. 4.

FIG. 6 is a horizontal transverse sectional view taken along the line 6—6 of FIG. 4.

FIG. 7 is a fragmentary end view taken on the line 7—7 of FIG. 6.

DESCRIPTION OF PRACTICAL EMBODIMENTS

Referring now by reference characters to the drawings which illustrate practical embodiments of the present invention, A designates a conventional interior door, as utilized, for example, with bedrooms, set within a frame 1 for normal swingable movement; said frame 1 being appropriately located within a wall 2. Said frame 1 comprises the usual side members 3, 3' and a header 4; said side members each incorporating the customary projecting jamb stop 5 with the usual accompanying shoulders 6, 6' for abutment of the former against the free edge-adjacent portion 7 of the rear face 8 of door A for restricting swinging thereof for normally closed condition (as shown in the drawings). Door A thus also comprehends the usual free outer end 9, with the end face thereof 9' being in confronting relationship with the adjacent face of side member 3 when door A is in closed condition; said door A having also the expected forward outer face 10. It is understood that the hinge (not shown) is engaged on the opposite end portion of door A, that is, at the end opposite end 9.

In addition to the normal locking arrangement securing door A and the associated side member 3 (not shown), there is provided an auxiliary latch device 11 which comprises a base support 12 for a pivotally mounted latching arm 13. Said device 11 is fabricated preferably of metal although a suitably rigid plastic could be effectively utilized. Said support 12 is of generally angular construction having a base leg 14 secured, as by means of a screw 15, upon the rearward face 8 of door A for confronting relationship with shoulder 6 when door A is closed. Provided at one end of base 14, and in perpendicular relationship thereto, is a mounting arm 16 which extends from the rear face of door A in planarwise parallel relationship to the face of jamb stop 5. Said mounting arm 16 receives a rivet 17 or other pivot pin for effecting swingable engagement with arm 13 which is thus adapted for swingable movement within a vertical plane parallel to the face of jamb stop 5. FIG. 3 illustrates, in phantom lines, said arm 13 in upwardly swing, inoperative position and with the effect of swing being manifestly terminated by abutment against door A. Said arm 13 is free in its end portion remote from the pivot axis established by member 17 and proximate its free end is provided with a recess 18 which opens outwardly through the normally lower end edge of said arm 13 as such is considered in viewing said arm 13 in its downward swinging movement into operative condition (see the arrow in FIG. 3). Said recess 18 is of suitable contour and depth for engaging the portion of the stem s of an abutment member 19 which may be in the character of a screw or other fastener, as desired. Said abutment member 19 is suitably secured within jamb stop 5 for limited projection therebeyond having, preferably, an enlarged head portion or end 20 at its outer end which is of greater cross section than recess 18 so as to inhibit any undesired displacement of arm 18 when disposed upon said abutment member 19.

Thus, the operation of auxiliary door latch 11 should be quite apparent from the foregoing in that it provides means for physically interengaging door A and the adjacent side member 3 in a highly efficient but most simply effected manner. Thus with arm 18 in downward or latched relationship with abutment member 19, door A is prevented from being opened inadvertently from the exterior so that ingress to the particular room is denied; and concurrently egress would be prevented a person such as a child, within the particular room since latch 11 would be located beyond reach and thus efficiently prevent opening even if the child could manipulate the customary door lock.

Therefore, in view of the foregoing, it will be seen that device 11 is comprised of a most limited number of parts which are of simple construction but are quite efficient in use; and with the same being amenable to high volume, low-cost production.

Referring now to FIGS. 4, 5, 6 and 7, another form of auxiliary door latch, indicated generally at 25, is illustrated. In describing this latch, it will be understood that the door construction components having corresponding elements in the drawings relating to latch 11 will be accorded the same reference letters and numerals.

In this embodiment, the auxiliary door latch 25 is comprised of a narrow latch plate 26 and a latch arm 27, the mutual cooperation of which will be described hereinbelow. Plate 26 is mounted upon the face of side member 3 normally opposed to the outer end face 9' of door A when the latter is in closed condition, said mounting being effected as by a pair of screws 28, 28' which are merely examples of any suitable fastening means. Said plate 26 is so disposed as to incorporate an outer end portion 26' which projects beyond the outer end face of said member 3 and door A when the latter is in closed condition and in such projecting portion 26' said plate 26 incorporates a narrow vertically extending slot-like opening 29.

The latch arm 27 is mounted upon a screw or like fastener 30 engaged at the inner end thereof within door A proximate the free end thereof but projecting outwardly from the outer face 10 thereof. Said fastener 30 at its outer end extremity has an enlarged head 31 and with there being a neck portion 32 extending between said head 31 and door outer face 10. Arm 27 is provided substantially with an elongated opening 33 having a longitudinal extent greater than the maximum dimension of fastener head 31 but having a cross sectional dimension less than that of fastener head 31 so as to present unauthorized detachment between fastener head 31 and arm 27 but permitting relative movement between the same so that arm 27 may be swingable about fastener 31 within a vertical plane as well as being shiftable about its longitudinal axis relative to fastener 31.

Thus, with reference to FIG. 7, it will be seen that arm 27 in inoperative position will normally be in a downwardly suspended disposition with respect to fastener 31. However, in order to dispose arm 27 in operative state, the same is rotated, as in the direction of the larger arrow shown in FIG. 7, at an angle of 90°, into normally horizontal disposition to permit alignment with opening 29 in plate 26. Thereupon, by reason of the length of opening 33, the user will then push arm 27 toward plate 26 so as to cause the adjacent end portion of arm 27 to enter opening 33 and project therebeyond; the length of opening 33 permitting such relative movement. Thus, in this condition, arm 27 is fully locked within plate 26 and thereby effectively serves to lock door A against unauthorized opening as by a child so as to deny entry into the room. The opposite end of arm 27 may be turned outwardly to provide a convenient finger-engageable surface, as at 34, to facilitate operation of plate 26.

It is apparent that the components of latch 25 may be fabricated of any suitable, durable rigid material, such as metal or thermosetting plastic, so that the same may be cheaply manufactured, being suitable for high volume production, as through stamping or molding as the case may be. Said arm 27 and plate 26 thus cooperate to present a reliable latching relationship and with the novel construction permitting facile operation of arm 27 to place same in operative or inoperative condition as the case may be.

What is claimed is:

1. In combination with a door and a frame therefor, said frame having a header and first and second opposed side jambs to define a door opening, each of said jambs having a laterally inwardly surface in mutual confronting relationship and an outwardly presented surface, means mounting one side of the door to one of said jambs for swingable movement thereof within the opening for selected closing thereof, the opposite side of said door being free, said door having an outer face substantially planarwise aligned with the outer surfaces of the jambs when the door is in closed condition, of an auxiliary latch for maintaining said door in closed condition comprising a mounting member fixed on the outer surface of said door and having a stem and a relatively enlarged head, an elongated relatively thin first latching element having opposed free ends, said first latching element having a longitudinally extending aperture of greater longitudinal and transverse extent than the thickness of said stem, said stem projecting through said aperture for supporting said first latching element for both free relative rotatable movement thereabout for longitudinal and horizontal shifting with respect thereto, said mounting member head being of greater cross-sectional extent than the transverse extent of said first latching element for preventing inadvertent displacement of the latter, such aperture being of such longitudinal extent to permit said first latching element to be shifted longitudinally between inoperative position wherein the jamb adjacent end will be located inwardly of the door free end and operative position wherein it will extend beyond said door free end, a second latching element having a base portion fixed to the jamb adjacent to the door free side when the latter is in closed condition, said second latching element having an outer end portion extending from said base and projecting beyond the outward surface of the related jamb, said second latching element outer end portion having a slot-like opening dimensioned for receiving the proximate end of said first latching element when the same is horizontally and longitudinally shifted into operative position thereby interengaging said first and second latching elements for retaining the door in closed condition.

2. The invention defined in claim 1 wherein securing means engage said second latching element base portion to the laterally inwardly directed surface of the related jamb, the outer portion of said second latching element extends outwardly beyond the outer surface of said jamb and of the door when the latter is closed, and said aperture is vertically elongated and disposed within the path of horizontal longitudinal shiftable movement for extension therethrough of the proximate end of said first latching element.

3. The invention defined in claim 2 wherein when said first latching element is in inoperative condition, unengaged to said second latching element, the latter will be rockable about mounting member stem into substantially vertical disposition, maximumly spaced from the door free side.

* * * * *